US010153544B2

(12) United States Patent
Zhang et al.

(10) Patent No.: US 10,153,544 B2
(45) Date of Patent: Dec. 11, 2018

(54) ELECTRONIC DEVICE AND PROTECTIVE HOUSING

(71) Applicants: Beijing Lenovo Software Ltd., Haidian District, Beijing (CN); Lenovo (Beijing) Co., Ltd., Haidian District, Beijing (CN)

(72) Inventors: Hua Zhang, Beijing (CN); Aiguo Zhang, Beijing (CN); Zhishan Ye, Beijing (CN)

(73) Assignees: BEIJING LENOVO SOFTWARE LTD, Haidian District, Beijing (CN); LENOVO (BEIJING) CO., LTD., Haidian District, Beijing (CN)

( * ) Notice: Subject to any disclaimer, the term of this patent is extended or adjusted under 35 U.S.C. 154(b) by 320 days.

(21) Appl. No.: 14/855,833

(22) Filed: Sep. 16, 2015

(65) Prior Publication Data

US 2016/0365627 A1 Dec. 15, 2016

(30) Foreign Application Priority Data

Jun. 9, 2015 (CN) ..... 2015 1 0313729

(51) Int. Cl.
*H01Q 1/38* (2006.01)
*H01Q 1/24* (2006.01)
(Continued)

(52) U.S. Cl.
CPC ..... *H01Q 1/38* (2013.01); *H01Q 1/24* (2013.01); *H01Q 1/243* (2013.01); *H01Q 9/04* (2013.01); *H01Q 9/42* (2013.01)

(58) Field of Classification Search
CPC ..... H01Q 1/24; H01Q 1/243; H01Q 9/04; H01Q 9/42; H01Q 1/38; H01Q 1/242
(Continued)

(56) References Cited

U.S. PATENT DOCUMENTS 9,059,505 B1 * 6/2015 Asrani ..... H01Q 9/145
2007/0291831 A1 * 12/2007 Lee ..... H01Q 1/243 375/227

(Continued)

FOREIGN PATENT DOCUMENTS

CN 103987223 A 8/2014
CN 104244648 A 12/2014
CN 105594059 A 5/2016

OTHER PUBLICATIONS

Office Action, and English language translation thereof, in corresponding Chinese Application No. 201510313729.9, dated Mar. 31, 2017, 22 pages.

*Primary Examiner* — Dameon E Levi
*Assistant Examiner* — Jennifer F Hu
(74) *Attorney, Agent, or Firm* — Brinks Gilson & Lione; John C. Freeman

(57) ABSTRACT

An electronic device and a protective housing are described. The electronic device has a housing body that includes a plurality of first component units and a plurality of second component units. The first component units include a first metal material, and the second component units are composed of a second isolation material and a second metal material. The plurality of first component units are arranged in a predetermined shape; the plurality of second component units are arranged at an outer edge of the predetermined shape, and the second metal material of the plurality of second component units is not connected with the first metal material of the first component units. The plurality of first component units constitute a radiating body of an antenna of the electronic device which may have an arbitrary shape, so freedom to set the antenna is raised.

13 Claims, 2 Drawing Sheets

(51) Int. Cl.
*H01Q 9/04* (2006.01)
*H01Q 9/42* (2006.01)

(58) Field of Classification Search
USPC ..... 343/702
See application file for complete search history.

(56) References Cited

U.S. PATENT DOCUMENTS

2014/0228080 A1* 8/2014 Choi ..... B29C 45/14639 455/575.1
2015/0188210 A1* 7/2015 Asrani ..... H01Q 9/145 455/575.7
2016/0218425 A1* 7/2016 Mohamadi ..... H01Q 3/24

* cited by examiner

ELECTRONIC DEVICE AND PROTECTIVE HOUSING

This application claims priority to Chinese patent application No. 201510313729.9 filed Jun. 9, 2015, the entire contents of which are incorporated herein by reference.

The present disclosure relates to an electronic device and protective housing.

BACKGROUND

In an electronic device such as a mobile phone and a tablet computer and the like, wireless signals are transmitted and received via an antenna. As enthusiasm for pursuing small size of the electronic device grows, space inside the electronic device is increasingly limited. As a result, freedom to dispose the antenna inside the electronic device is reduced.

In the prior art, in order to solve the problem of having difficulty in disposing the antenna inside the electronic device, there is proposed a solution of disposing the antenna on the frame of a housing body of the electronic device. However, since the shape of the housing body of the electronic device is already determined, it is incapable of disposing an antenna with an arbitrary shape so that freedom to dispose the antenna is not improved.

SUMMARY

The present disclose is made in view of the above problem and aims at providing an electronic device and a protective housing, so that freedom to set an antenna is raised and it is capable of forming a radiating body of an antenna with an arbitrary shape on a housing body or a protective housing of the electronic device.

According to one aspect of the present disclosure, there is provided an electronic device. The electronic device comprises: a housing body, comprising a plurality of first component units and a plurality of second component units, wherein the first component units include a first metal material, and the second component units are composed of a second isolation material and a second metal material; and the plurality of first component units are arranged in a predetermined shape, the plurality of second component units are arranged at an outer edge of the predetermined shape, and at the edge of the predetermined shape, the second metal material of the plurality of second component units is not connected with the first metal material of the first component units; wherein the plurality of first component units arranged in the predetermined shape constitute an radiating body of an antenna of the electronic device.

According to another aspect, there is provided a protective housing installed on an electronic device to form a housing body of the electronic device. The protective housing comprises a plurality of first component units and a plurality of second component units, wherein the first component units include a first metal material, and the second component units are composed of a second isolation material and a second metal material; and the plurality of first component units are arranged in a predetermined shape, the plurality of second component units are arranged at an outer edge of the predetermined shape, and at the edge of the predetermined shape, the second metal material of the plurality of second component units is not connected with the first metal material of the first component units; wherein the plurality of first component units arranged in the predetermined shape constitute an radiating body of an antenna of the electronic device.

The electronic device and the protective housing according to the present disclosure arrange the plurality of first component units in the predetermined shape, and arrange the plurality of second component units at the edge of the predetermined shape, so that the first component units and the second component units are insulated. Therefore, it is capable of forming the radiating body of the antenna by the plurality of first component units, and it is capable of forming a radiating body with an arbitrary shape through arranging the plurality of first component units in an arbitrary shape, so that freedom to dispose the antenna can be raised.

DETAILED DESCRIPTION

Implementations of the present disclosure are described below with reference to accompanying figures. Descriptions made with reference to the figures are provided below to help understanding exemplary implementations of the present disclosure defined by the claims and their equivalents. The descriptions comprise various specific details being helpful for understanding, but they are only taken as exemplary. Therefore, those skilled in the art would recognize that various alternations and amendments can be made to the implementations described herein, without departing from the scope and spirit of the present disclosure. Furthermore, in order to make the specification simple, detailed description of functions and constructions well known in the art will be omitted.

Figure 1:
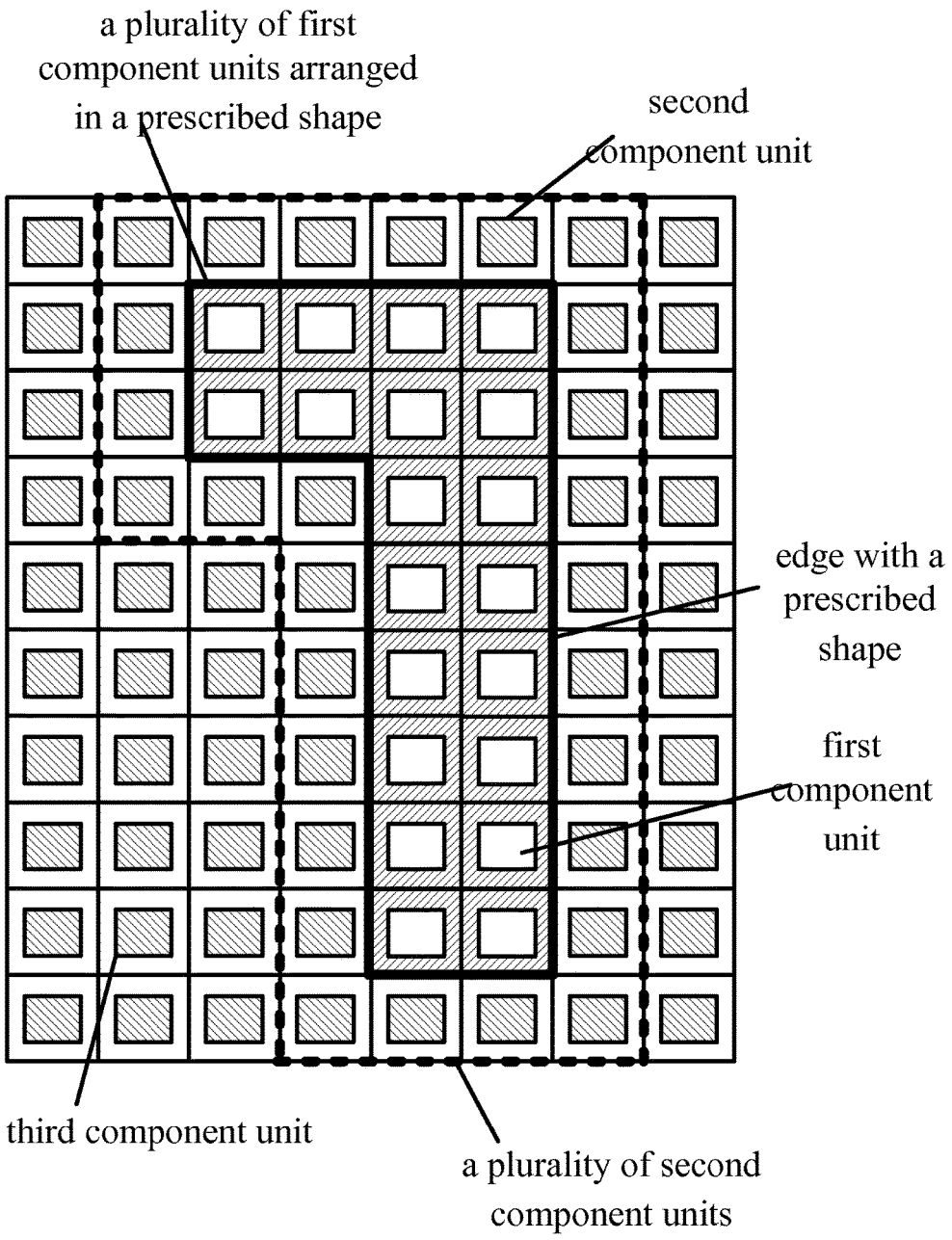
FIG. 1 shows an exemplary diagram of a part of region of a housing body of an electronic device according to an implementation of the present disclosure.

A housing body according to an implementation of the present disclosure is described below with reference to FIG. 1. FIG. 1 shows an exemplary diagram of a part of region of a housing body of an electronic device according to the implementation of the present disclosure.

As shown in FIG. 1, the housing body of the electronic device comprises a plurality of first component units and a plurality of second component units. Herein, as described below, the plurality of first component units constitute a radiating body of an antenna of the electronic device.

In the implementation of the present disclosure, the electronic device is for example a mobile phone, a tablet computer and the like, but is not limited thereto, only if the electronic device is capable of transmitting and receiving wireless signals.

In addition, in the implementation of the present disclosure, the electronic device has for example a wireless signal processing means. The wireless signal processing means is connected with the radiating body of the antenna formed in the housing body of the electronic device through a feed point. Thus, the wireless signal generated by the wireless signal processing means is delivered to the radiating body of the antenna formed in the housing body of the electronic device through the feed point, and is radiated by the radiating body. In addition, the wireless signal received by the radiating body is delivered to the wireless signal processing means through the feed point, so that processing comprising demodulating, decoding and so on are performed by the wireless signal processing means.

Preferably, a plurality of first component units are arranged on a first side of the housing body. For example, in the exemplary diagram as shown in FIG. 1, the plurality of first component units are arranged on the back side of the housing body (for example, the back housing of the electronic device). However, the plurality of first component units may also be arranged on another side of the housing body (for example, a front side, i.e., a side configured with a display module), and the plurality of first component units may also be arranged on a plurality of sides of the housing body.

Figure 2:
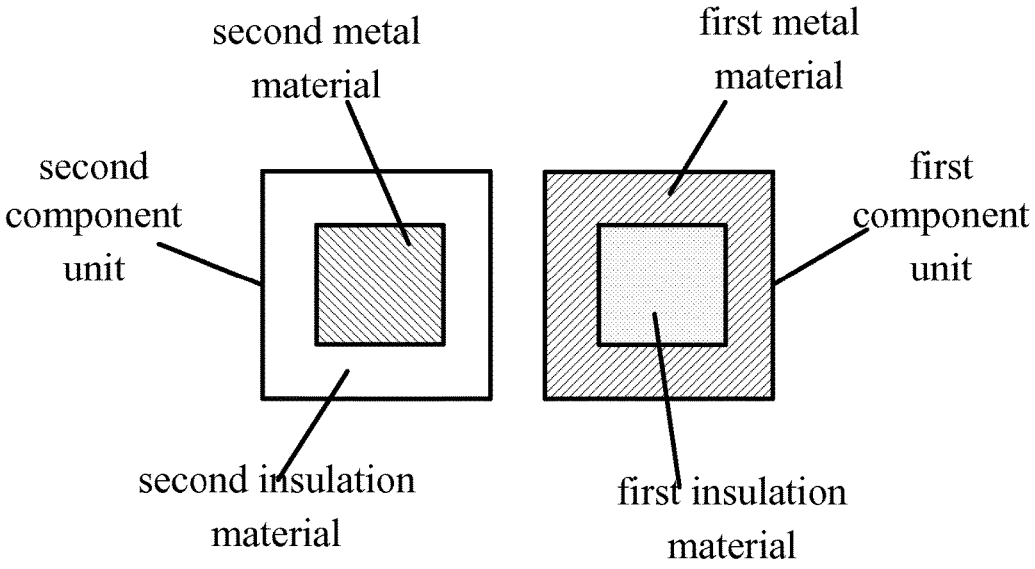
FIG. 2 shows an exemplary diagram of structures of first component units and second component units according to an implementation of the present disclosure.

Structures of the first component units and the second component units according to an implementation of the present disclosure will be described below with reference to FIG. 2. As shown in FIG. 2, the first component units include a first metal material and a first insulation material, and the second component units include a second metal material and a second insulation material.

Herein, in the implementation of the present disclosure, the first component units may not include a first insulation material. As described above, the plurality of first component units constitute the radiating body of the antenna of the electronic device, and thus electrical connection is required to be made between or among the plurality of first component units. Therefore, the first component units according to the implementation of the present disclosure include the first metal material.

Herein, the first metal material and the second metal material can be the same material. Also, the first insulation material and the second insulation material can be the same material. In the below description, for the purpose of description, the materials are represented as the first metal material and the second metal material, and the first insulation material and the second insulation material, respectively.

Returning to FIG. 1, the plurality of first component units are arranged in an inverted-L shape (i.e., a predetermined shape), but they can be arranged in other shapes such as circular and so on according to frequency band, usage and so on of the antenna. In addition, as shown in FIG. 1, the plurality of second component units are arranged at an outer edge of the predetermined shape in the predetermined shape. In particular, in FIG. 1, the plurality of the second component units are arranged at an outer edge of the inverted-L shape in the inverted-L shape. That is, the plurality of second component units surround the first component units arranged in the inverted-L shape.

As described above, the plurality of first component units arranged in the predetermined shape constitute the radiating body of the antenna of the electronic device, and thus electrical connection is required to be made between or among the plurality of first component units, and the plurality of first component units are insulated from the plurality of second component units arranged at the outer edge thereof.

Therefore, in the implementation of the present disclosure, at the edge of the predetermined shape, the second metal material of the plurality of second component units is not connected with the first metal material of the first component units. In particular, in FIG. 1, at the edge of the inverted-L shape, the second metal material of the plurality of second component units is not connected with the first metal material of the first component units, so that it is ensured that the plurality of first component units are insulated from the plurality of second component units arrange at the outer edge thereof.

In addition, in the case that the plurality of first component units do not include the first insulation material, electrical connection is required to make between or among the plurality of first component units. In addition, in the case that the first component units include the first insulation material, the first metal materials are connected among the plurality of first component units in order to ensure that electrical connection is made between or among the plurality of first component units.

As described above, the radiating body of the antenna formed in the housing body of the electronic device is connected with the wireless signal processing means through the feed point. In particular, in the implementation of the present disclosure, it can be done by connecting the first metal material of the first component units constituting the radiating body with the feed point of the electronic device. Thus, the radiating body of the antenna and the wireless signal processing means are connected, so that it is capable of delivering the wireless signal to be transmitted and the wireless signal received.

The electronic device according to the implementation of the present disclosure arranges the plurality of first component units in an array form to constitute the radiating body of the antenna, so that the radiating body of the antenna with arbitrary shape can be formed flexibly. In addition, since the antenna formed in the housing body would not occupy inside space of the electronic device, it is especially suited for a small-size electronic device.

In the exemplary diagram of the housing body as shown in FIG. 1, there are further comprised a plurality of third component units being composed of a third insulation material and a third metal material. However, the third component units may also be composed of only the third insulation material or only the third metal material. Herein, the third metal material may be the same as that of the first metal material or the second metal material; also, the third insulation material may be the same as the first insulation material or the second insulation material. In the following description, for the purpose of description, the materials are represented as the third metal material and the insulation material, respectively.

In addition, in the region of FIG. 1 configured with the third component units, the third component units can be disposed in a non-array form, but directly formed into a metal material side or an insulation material side. Herein, FIG. 1 only illustrates the back side of the housing body. The third component units can be disposed in the array form in another side, or disposed in the non-array form but directly formed into the metal material side or the insulation material side.

As shown in FIG. 1, in a first side on which the radiating body of the antenna is formed, the plurality of first component units, the plurality of second component units and the plurality of third component units are arranged in the array form, respectively. In the process of manufacturing, the plurality of first component units can be arranged in an arbitrary shape, so that the second component units and the third component units are arranged in the first side. In this way, freedom of the radiating body of the antenna is raised. In particular, the plurality of first component units, the plurality of second component unit and the plurality of third component units are manufactured firstly, and different types of component units are concatenated in the array form, then the first side of the housing body is formed. In particular, in the process of concatenating, the plurality of first component units are concatenated in the predetermined shape, and the plurality of second component units are concatenated at the outer edge of the plurality of first component units, and thus the plurality of third component units are concatenated in other regions, so that the first side of the housing body is formed. In addition, in the case that the plurality of third component units are also arranged in the array form in another side of the housing body, said another side of the housing body can be formed only if the respective third component units are concatenated. In addition, in the process of debugging the antenna, it is only required to adjust the arrangement form of the plurality of first component units, which reduces the cost required for debugging.

Herein, concatenation between the respective component units may be concatenation between the metal materials, or may be concatenation between the metal material and the insulation material, or may be concatenation between the insulation materials. In the implementation of the present disclosure, the concatenating modes between the respective materials are not limited only if the respective component units can be concatenated to form the housing body.

In the case that the plurality of first component units, the plurality of second component units and the plurality of third component units are concatenated to form the first side of the housing body of the electronic device, the first side of the housing body has a metal-holding feeling because the plurality of second component units and the plurality of third component units include the second metal material and the third metal material respectively, so that the user's holding experience can be raised.

Preferably, as shown in FIG. 2, in the first component units, the first insulation material is formed into a prescribed pattern (square) in the central part of the first component units; in the second component units, the second metal material is formed into a prescribed pattern in the central part of the second component units. Likewise, in the third component units, the third metal material is formed into a prescribed pattern in the central part of the third component units. In addition, the prescribed pattern is not limited to square, and can be an arbitrary pattern such as circular or heart-shaped, etc. Thus, it looks that the first side of the housing body of the electronic device formed by concatenating the first component units, the second component units and the third component units has a uniform shape, so that virtual experience of the user is raised, and the appearance of the electronic device becomes uniform.

Of course, in the implementation of the present disclosure, different types of the component units can be formed into a different prescribed pattern only if the plurality of first component units arranged in the predetermined shape can constitute the radiating body of the antenna. For example, also, different prescribed patterns can be formed according to positions of the respective first component units in the first side of the housing body, so that a cartoon pattern and so on can be formed on the entire first side of the housing body.

In addition, in the second component units, the second metal material is formed in the central part of the second component units, and thus the second metal material of the second component units would not be connected with the first metal material of the first component units, so as to be capable of ensuing that the first component units are insulated from the second component units.

Further, preferably, as shown in FIG. 2, the first component units and the second component units are formed into the same shape and/or size. For example, in FIG. 2, the first component units and the second component units are formed into squares. Likewise, the third component units are also formed into the shape and/or size the same as that of the first component units or the second component units.

Since the same shape is formed between different types of component units, it is capable of performing concatenation between different types of component units conveniently. In addition, by forming different types of component units as the same size, the visual experience of the user can be raised, and the appearance of the electronic device becomes uniform. Preferably, the first component units, the second component units and the third component units are formed into squares with side length of about 0.05 cm. Herein, the size is not limited thereto. It can be an arbitrary size only if the visual experience of the user can be raised. Of course, in the implementation of the present disclosure, different types of component elements can also be formed into different shapes and different sizes only if the plurality of first component units arranged in the predetermined shape are capable of constituting the radiating body of the antenna.

Further, preferably, in the first component units, the first insulation material is embedded into the first metal material; in the second component units, the second metal material is embedded into the second insulation material. Also, in the third component units, the third metal material is embedded into the third insulation material. The insulation material and the metal material included in a same type of component units are formed into an embedded structure. Therefore, in a same type of component units, it is capable of enabling for example the thickness of the insulation material and that of the metal material to keep consistent conveniently. Thus, in the first side of the housing body of the electronic device formed by concatenating the first component units, the second component units and the third component units, the thickness at respective positions is capable of being kept consistent, so that the holding experience of the user can be further raised.

In addition, for example, in the first component units, the structure of the first insulation material and the first metal material is not limited to the embedded structure, and can also be formed into for example a structure in which the first insulation material is covered on the first metal material and so on. Likewise, in the second component units and the third component units, the structure of the insulation material and the metal material is not limited to the embedded structure, and can also be formed into for example a structure in which the metal material is covered on the insulation material and so on.

In addition, the back side of the housing body of the electronic device as shown in FIG. 1 can represent a protective housing installed on the electronic device to form the housing body of the electronic device. Now, the protective housing comprises a plurality of first component units and a plurality of second component units. Herein, the protective housing is installed on an electronic device (for example, a mobile phone, etc.) being capable of transmitting and receiving a wireless signal.

Herein, like the back side of the housing body as shown in FIG. 1, the plurality of first component units comprised in the protective housing constitute a radiating body of an antenna. For example, when the protective housing is installed on the electronic device, the radiating body of the antenna formed in the protective housing is connected with a wireless signal processing means inside the electronic device through a feed point. Thus, the wireless signal generated by the wireless signal processing means is delivered to the radiating body of the antenna formed in the protective housing through the feed point, and is radiated by the radiating body. In addition, the wireless signal received by the radiating body is delivered to the wireless signal processing means through the feed point, so that processing comprising demodulating, decoding and so on are performed by the wireless signal processing means.

As described above, the first component units comprised in the protective housing include a first metal material, and the second component units comprised in the protective housing are composed of a second insulation material and a second metal material. Herein, as shown in FIG. 1, the plurality of first component units are arranged in the predetermined shape (inverted-L shape), and the plurality of second component units are arranged at the outer edge of the predetermined shape in the predetermined shape. In particular, the plurality of second component units surround the first component units formed in the inverted-L shape. Herein, the plurality of first component units arranged in the predetermine shape constitute the radiating body of the antenna of the electronic device.

In addition, in order to ensure that the plurality of first component units are insulated from the plurality of second component units arranged at the outer edge of the first component units, at the edge of the predetermined shape of the protective housing, the second metal material of the plurality of second component units is not connected with the first metal material of the first component units.

As described above, when the protective housing is installed on the electronic device, the radiating body of the antenna formed in the protective housing is connected with the wireless signal processing means inside the electronic device through the feed point. In particular, in the implementation of the present disclosure, in the case that the protective housing is installed on the electronic device, the first metal material of the first component units constituting the radiating body is connected with the feed point of the electronic device. Thus, the radiating body of the antenna formed in the protective housing and the wireless signal processing means are connected, so that it is capable of delivering the wireless signal to be transmitted and the wireless signal received.

The protective housing according to the implementation of the present disclosure arranges the plurality of first component units in an array form to constitute the radiating body of the antenna, so that the radiating body of the antenna with an arbitrary shape can be formed flexibly. In addition, since the antenna formed in the housing body would not occupy inside space of the electronic device, it is especially suited for a small-size electronic device.

Preferably, the protective housing further comprises a plurality of third component units being composed of a third insulation material and a third metal material. Herein, the protective housing is constituted by concatenating the first component units, the second component units and the third component units. Herein, as described above, in a region configured with the third component units, the third component units may be disposed in a non-array form, but directly formed into a metal material side or an insulation material side.

Preferably, as shown in FIG. 2, the first component units further comprise a first insulation material. Now, in order to ensure connection between or among the plurality of first component units, and the first metal material is connected among the plurality of first component units.

Referring to FIG. 1, in the protective housing, the plurality of first component units, the plurality of second component units and the plurality of third component units are arranged in the array form, respectively. In the process of manufacturing, the plurality of first component units can be arranged in an arbitrary shape, and then the second component units and the third component units are arranged in the first side, such that freedom of the radiating body of the antenna is raised. In particular, the plurality of first component units, second component unit and third component units are manufactured firstly, and different types of component units are concatenated in the array form, then the protective housing can be formed. In particular, in the process of concatenating, the plurality of first component units are concatenated in the predetermined shape, and the second component units are concatenated at the outer edge of the first component units, and then the third component units are concatenated in other regions, so that the protective housing can be formed. In addition, in the process of debugging the antenna, it is only required to adjust the arrangement form of the plurality of first component units, which reduces the cost required for debugging.

Herein, concatenation between the respective component units may be concatenation between the metal materials, or may be concatenation between the metal material and the insulation material, or may be concatenation between the insulation materials. In the implementation of the present disclosure, the concatenating modes between the respective materials are not limited only if the respective component units can be concatenated to form the protective housing.

In the case that the first component units, the second component units and the third component units are concatenated to form the protective housing, the first side of the housing body has a metal-holding feeling because the second component units and the third component units include the second metal material and the third metal material respectively, so that the user's holding experience can be raised.

Preferably, as shown in FIG. 2, in the first component units, the first insulation material is formed into a prescribed pattern (square) in the central part of the first component units; in the second component units, the second metal material is formed into a prescribed pattern in the central part of the second component units. Likewise, in the third component units, the third metal material is formed into a prescribed pattern in the central part of the third component units. In addition, the prescribed pattern is not limited to square, and can be an arbitrary pattern such as circular or heart-shaped, etc. Thus, it looks that the protective housing formed by concatenating the first component units, the second component units and the third component units has a uniform shape, so that virtual experience of the user is raised, and the appearance of the electronic device becomes uniform.

In addition, in the second component units, the second metal material is formed in the central part of the second component units, and thus the second metal material of the second component units would not be connected with the first metal material of the first component units, so as to be capable of ensuring that the first component units are insulated from the second component units.

Further, preferably, with reference to FIG. 2, the first component units and the second component units are formed into the same shape and/or size. For example, in FIG. 2, the first component units and the second component units are formed into squares. Likewise, the third component units are also formed into the shape and/or size the same as that of the first component units or the second component units.

Since the same shape is formed between different types of component units, it is capable of concatenating different types of component units conveniently. In addition, by forming different types of component units as the same size, the visual experience of the user can be raised, and the appearance when the protective body is installed on the electronic device becomes uniform. Preferably, the first component units, the second component units and the third component units are formed into squares with side length about 0.05 cm. Herein, the size is not limited thereto. It can be an arbitrary size only if the visual experience of the user can be raised.

Further, preferably, in the first component units, the first insulation material is embedded into the first metal material; in the second component units, the second metal material is embedded into the second insulation material. Also, in the third component units, the third metal material is embedded into the third insulation material. The insulation material and the metal material included in a same type of component units are formed into an embedded structure. Therefore, in a same type of component units, it is capable of enabling for example the thickness of the insulation material and that of the metal material to be kept consistent conveniently. Thus, in the protective housing formed by concatenating the first component units, the second component units and the third component units, the thickness at respective positions keeps consistent, so that the holding experience of the user can be further raised.

Respective implementations of the present disclosure are described above in detail. However, those skilled in the art shall understand that various amendments, combination or sub-combinations are made to these implementations without departing the principle and spirit of the present disclosure, and these amendments shall be fallen into the scope of the present disclosure.

The invention claimed is:

1. An electronic device comprising:

a housing body comprising a plurality of first component units and a plurality of second component units, each of the first component units includes a first metal material and a first insulation material, and the second component units are composed of a second isolation material and a second metal material;

the plurality of first component units are arranged in a predetermined shape; the plurality of second component units are arranged at an outer edge of the predetermined shape and, at the edge of the predetermined shape, the second metal material of the plurality of second component units is not connected with the first metal material of the first component unit, wherein the plurality of first component units arranged in the predetermined shape constitute a radiating body of an antenna of the electronic device, and in each of the first component units, the first insulation material is formed into a prescribed pattern in a central part of each of the first component units, wherein in the second component units, the second metal material is formed into a prescribed pattern in a central part of the second component units, and the first component units and the second component units are formed into the same shape and/or size.

2. The electronic device according to claim 1, wherein the plurality of first component units are arranged in the predetermined shape in a first side of the housing body.

3. The electronic device according to claim 1, wherein the housing body further comprises a plurality of third component units being composed of a third insulation material and a third metal material, and the first side of the housing body is constituted by concatenating the first component units, the second component units and the third component units.

4. The electronic device according to claim 3, wherein the first metal material is connected among the plurality of first component units arranged in the predetermined shape, so as to constitute the radiating body of the antenna.

5. The electronic device according to claim 4, wherein in the third component units, the third metal material is formed into a prescribed pattern in a central part of the third component units.

6. The electronic device according to claim 4, wherein the first component units, the second component units and the third component units are formed into a same size.

7. The electronic device according to claim 4, wherein in the first component units, the first insulation material is embedded into the first metal material, in the second component units, the second metal material is embedded into the second insulation material, and in the third component units, the third metal material is embedded into the third insulation material.

8. A protective housing installed on an electronic device to form a housing body of the electronic device, comprising:

a plurality of first component units and a plurality of second component units, wherein each of the first component units includes a first metal material and a first insulation material, and the second component units are composed of a second isolation material and a second metal material, the plurality of first component units are arranged in a predetermined shape; the plurality of second component units are arranged at an outer edge of the predetermined shape, and at the edge of the predetermined shape, the second metal material of the plurality of second component units is not connected with the first metal material of the first component unit, wherein the plurality of first component units arranged in the predetermined shape constitute a radiating body of an antenna of the electronic device and in each of the first component units, the first insulation material is formed into a prescribed pattern in a central part of each of the first component units, wherein in the second component units, the second metal material is formed into the prescribed pattern in a central part of the second component units, and the first component units and the second component units are formed into the same shape and/or size.

9. The protective housing according to claim 8, wherein the protective housing further comprises a plurality of third component units being composed of a third insulation material and a third metal material, and the protective housing is constituted by concatenating the first component units, the second component units and the third component units.

10. The protective housing according to claim 9, wherein the first metal material is connected mutually between the plurality of first component units arranged in the predetermined shape.

11. The protective housing according to claim 10, wherein in the third component units, the third metal material is formed into the prescribed pattern in a central part of the third component units.

12. The protective housing according to claim 10, wherein the first component units, the second component units and the third component units are formed into a same size.

13. The protective housing according to claim 10, wherein in the first component units, the first insulation material is embedded into the first metal material, in the second component units, the second metal material is embedded into the second insulation material, and in the third component units, the third metal material is embedded into the third insulation material.

* * * * *